US007631699B2

(12) United States Patent
Cisneros

(10) Patent No.: US 7,631,699 B2
(45) Date of Patent: Dec. 15, 2009

(54) SYSTEM AND METHOD FOR PRESSURE ISOLATION FOR HYDRAULICALLY ACTUATED TOOLS

(75) Inventor: Fred Cisneros, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 335 days.

(21) Appl. No.: 11/500,063

(22) Filed: Aug. 7, 2006

(65) Prior Publication Data

US 2008/0029275 A1 Feb. 7, 2008

(51) Int. Cl.
*E21B 23/08* (2006.01)

(52) U.S. Cl. ..... 166/382; 166/208; 166/386; 166/387

(58) Field of Classification Search ..... 166/382, 166/208, 386, 387
See application file for complete search history.

(56) References Cited

U.S. PATENT DOCUMENTS 4,391,325 A * 7/1983 Baker et al. ..... 166/208
4,669,538 A 6/1987 Szarka
4,726,419 A 2/1988 Zunkei
5,038,860 A * 8/1991 Baugh et al. ..... 166/208
5,170,847 A 12/1992 Mims et al.
5,553,672 A 9/1996 Smith et al.
6,032,734 A 3/2000 Telfer
6,138,761 A 10/2000 Freeman et al.
6,263,968 B1 7/2001 Freeman et al.
6,681,860 B1 * 1/2004 Yokley et al. ..... 166/382
6,877,567 B2 4/2005 Hirth
7,114,573 B2 10/2006 Hirth et al.

* cited by examiner

*Primary Examiner*—William P Neuder
*Assistant Examiner*—Nicole A Coy
(74) *Attorney, Agent, or Firm*—Mossman, Kumar & Tyler PC

(57) ABSTRACT

An isolation device operatively coupled to a wellbore tool is activated upon receiving fluid that a predetermined applied pressure. When the fluid string reaches the predetermined applied pressure, the isolation device undertakes a specified action such as longitudinal movement, rotation, expansion, etc. that actuates or operates the wellbore tool. Premature actuation of the wellbore tool is prevented by applying a resistive force to the isolation device that, alone or in cooperation with another mechanism, arrests movement of the isolation device. This resistive force is generated by applied pressure of the fluid in the work string.

18 Claims, 5 Drawing Sheets

SYSTEM AND METHOD FOR PRESSURE ISOLATION FOR HYDRAULICALLY ACTUATED TOOLS

CROSS-REFERENCE TO RELATED APPLICATIONS

None.

BACKGROUND OF THE INVENTION

1. Field of the Invention

The present invention relates to systems for pressure isolation of one or more tools adapted for use in a wellbore.

2. Description of the Related Art

Hydrocarbons such as oil and gas are recovered from a subterranean formation using a wellbore drilled into the formation. A number of tools are used throughout the process of drilling and completing the wellbore and also during the production life of the well. Many of these tools are energized using pressurized fluid that is self-contained in the tool, pumped downhole from the surface, or fluid that is produced from the well itself. These tools, which are sometimes referred to as hydraulically actuated tools, can be put to a number of uses.

One use for hydraulically actuated tools is to set a liner hanger. During drilling, the wellbore is lined with a string of casing that is cemented in place to provide hydraulic isolation and wellbore integrity. The liner hanger is used to hang or anchor a liner off of a string of other casing string. Several types of liner hangers are known in the art, which includes hydraulic liner hangers. In conventional hydraulic liner hangers, fluid is supplied under pressure into an annular space between a mandrel and a surrounding cylinder. The hydrostatic pressure of the fluid between the cylinder and the mandrel creates a force on the inner surface area of the cylinder that causes the cylinder to slide longitudinally. Hydraulically actuated liner hangers are illustrative of wellbore tools that utilize an applied fluid pressure for operation.

Because conventional hydraulically actuated wellbore tools, such as liner hangers, utilize relatively high fluid pressure for activation, these tools can be vulnerable to high fluid pressures occurring after setting or activation. For instance, during pressure testing of a liner hanger assembly, the relatively high test pressures can rupture seals between a cylinder and mandrel or even deform the relatively thin mandrel. Typically, expensive seals and costly materials are used in these wellbore tools to reduce the risk of failure do to exposure to high post-activation pressures.

The present invention addresses these and other drawbacks of the prior art.

SUMMARY OF THE INVENTION

In aspects, the present invention provides systems, devices, and methods to selectively isolate one or more portions of a wellbore tool from applied wellbore pressure. This applied pressure can be communicated to portions of the wellbore tool via a port or other orifice open to the wellbore or tool flow bore. In one embodiment, an isolation device protection device includes a sealing member positioned proximate to the port that moves into a sealing relationship with the port after the wellbore tool has been set. An actuating member positioned next to the sealing member translates or otherwise displaces the sealing member into sealing engagement with the port. In one arrangement, actuating member includes a biasing element such as a spring and is retained in a pre-activated position by a retaining element. The retaining element can include a shoulder or stop formed within the wellbore tool.

In certain embodiments, the present invention can be used to protect portions of hydraulically actuated wellbore tools such as liner hangers. Liner hangers typically include a cylinder disposed around a mandrel. The cylinder slides along the mandrel when an applied pressure of a sufficient magnitude is generated in a pressure chamber in the liner hanger. This pressure chamber communicates with the tool flow bore or wellbore via a port formed in the mandrel. For such devices, the sealing member can seal off the port after the applied wellbore pressure sets the wellbore tool. Thus, components such as seals or thin walled cylinders are isolated from fluid pressure in the wellbore. The sealing member can include sealing elements to ensure that fluid does not leak out of the pressure chamber as the applied pressure is setting the hydraulically actuated tool. If, after setting, the fluid in the pressure chamber prevents the sealing member from seating properly over the port, then the sealing member includes a flow element such as a valve that selectively bleeds fluid from the pressure chamber after the wellbore tool has been set.

The isolation device can be configured to operate liner hangers as well as other tools used in the wellbore. Moreover, in addition to drilling fluid, the pressurized fluid can be water, synthetic material, hydraulic oil, or formation fluids.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1:
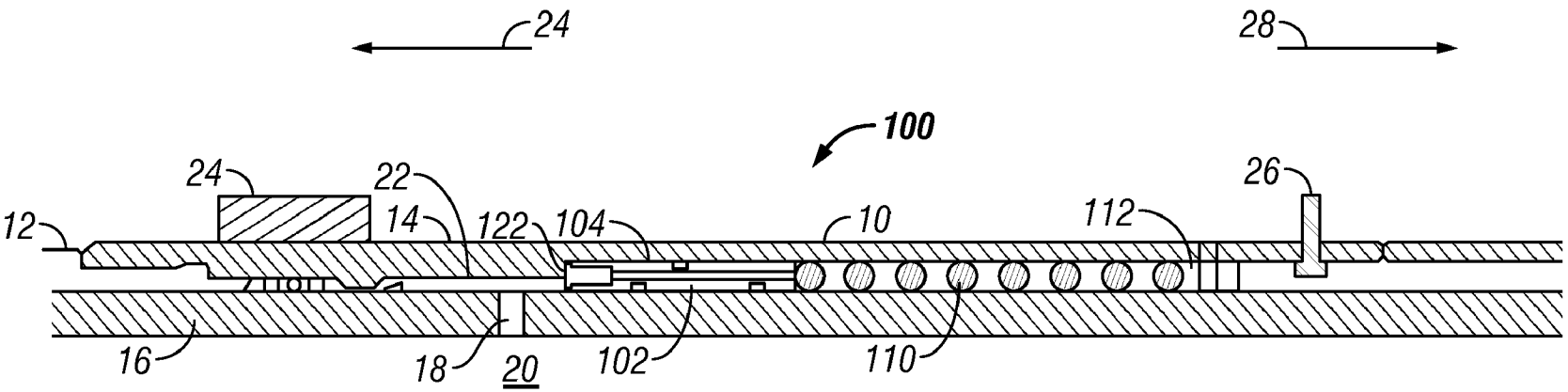
FIG. 1 schematically illustrates one embodiment of an isolation tool made in accordance with the present invention.

The present invention relates to devices and methods for pressure isolation of hydraulically actuated wellbore tools. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. Indeed, as will become apparent, the teachings of the present invention can be utilized for a variety of well tools and in all phases of well construction and production. Accordingly, the embodiments discussed below are merely illustrative of the applications of the present invention.

Referring initially to FIG. 1, there is schematically illustrated one embodiment of a pressure isolation device 100 made in accordance with the present invention for pressure isolating one or more sections of a tool 10 conveyed via a work string 12 into a wellbore. Although the isolation device 100 can be used in connection with nearly any tool, for simplicity, the isolation device 100 will be discussed in the context of a hydraulically actuated liner hanger having an outer member or cylinder 14 and an inner member or mandrel 16. In a conventional manner, a port 18 formed in the mandrel 16 provides fluid communication between a tool bore 20 and a chamber 22. The chamber 22 is hydraulically sealed by seals or packing 24 and the isolation device 100. During use, a pressure increase in the bore 20 causes a corresponding pressure increase in the chamber 22. The applied pressure generates a force that urges the cylinder 14 to slide in the direction 24. This sliding movement can actuate slips (not shown) in the case of liner hangers or open or close a valve or perform some other desired function. As will be seen, after the tool 10 is set, the isolation device 100 seals the port 18 to thereby substantially prevent fluid communication between the bore 20 and the chamber 22 and other external sections of the tool 10. As should be appreciated, this isolation can shield external components of the tool 10 from relatively high pressures in the bore 20 that may be generated during activities such as pressure testing.

Figure 2:
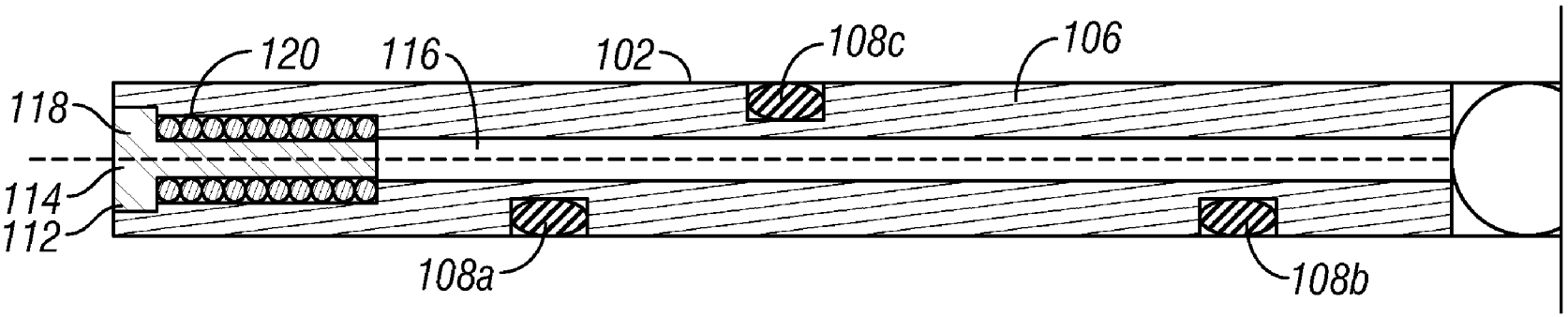
FIG. 2 schematically illustrates a sectional view of an embodiment of a sealing member.

In one embodiment, the isolation device 100 includes a sealing member 102 positioned in a space 104 between the cylinder 14 and the mandrel 16. Referring now to FIGS. 1 and 2, the sealing member 102 includes a ring-like body 106 on which are positioned sealing elements 108. An actuating element 110 adjacent to the sealing member 102 pushes or slides the sealing member 102 over or around the port 18 once a predetermined pressure condition is reached. In one embodiment, the actuating element 110 is a biasing member such as a spring that is retained within the space 104 by a retaining member 112. However, in other embodiments, the actuating element 110 can use pressurized fluid such as gas, an electric or hydraulic motor, one or more magnetic elements, piezoelectric elements and other devices suited to push or otherwise displace the sealing member 102.

In one embodiment, the sealing elements 108*a-c* are disposed on both the interior and exterior surfaces of the body 106 to form fluid barriers between the body 106 and the cylinder 14 and between the body 106 and the mandrel 16. The interior and exterior sealing elements 108*a-c* cooperate to allow the chamber 22 to develop a pressure differential sufficient to displace the cylinder 14. After the cylinder 14 has been displaced, the interior seals 108*a,b* straddle and seal off the port 18. These seals, which do not need to be a "zero leakage" seals, enable a substantial pressure differential thereacross. It should be understood that any number of different sealing arrangements can be utilized. For instance, in some applications, a sealing element (not shown) can be positioned in the retaining member 112, which could eliminate the need for a sealing element on the exterior surface. Furthermore, a biased detent element such as a ball may be used to plug the port 18, which could eliminate the need for a sealing element on the interior surface. In still other embodiments, the tolerances between the sealing member and the mandrel and the cylinder can be selected to reduce fluid leakage to a level where no seal elements would be needed.

In some embodiments, the mostly incompressible fluid occupying the chamber 22 could effectively prevent the sealing member 102 from sliding over the port 18. Referring now to FIG. 2, to vent or bleed fluid from the chamber 22, the sealing member 102 can include one or more flow control elements 112. The flow control element 112 permits fluid to flow out of the chamber 22 under one or more preset conditions. In one arrangement, the flow control element 112 includes a valve 114 that selectively blocks fluid communication through a conduit 116 traversing the sealing member 102. In one embodiment, the valve 114 includes a piston member 118 that is urged to an open position by a biasing member 120. A suitably high hydraulic pressure in the chamber 22 urges the piston member 118 into a closed position. In some arrangements, it may be desired to maintain the valve 114 in a closed position before activation regardless of the pressure in the chamber 22. One suitable arrangement for holding the valve 114 in the closed position in such situations is shown in FIG. 1. As shown, a shoulder 122 is formed on the cylinder 14 that protrudes into the space 104 to provide a seating surface for piston member 118 of the valve 114. The biasing force generated by the actuating member 110 overcomes the biasing force of the biasing member 120, which allows the piston member 118 to move. In another embodiment, the flow control element 112 can include a rupture disk (not shown) that fractures or disintegrates at a predetermined pressure. In still other embodiments, the flow control element 112 can include plugs or other elements that melt or disintegrate upon exposure to heat, pressure, a chemical, etc.

The operation of the isolation device 100 will be described with reference to FIGS. 1-4. In FIG. 1, the isolation device 100 is shown in a pre-activated position wherein the port 18 is unblocked and fluid flows freely between the bore 20 and the chamber 22. The pressure in the chamber 22 can vary as the tool 10 is tripped into the well; e.g., it could be at, below or above a hydrostatic pressure. These pressure variations do not affect the isolation device 100. For example, the shoulder 122 prevents sliding or translation of the sealing element 102 in the direction 24. Additionally, pressure variations will not affect the valve 114, which is held in a closed position by the actuating member 110 pressing the valve 114 against the shoulder 122. Thus, prior to an activation pressure of the tool 10 being generated in the well, the tool 10 and the isolation device 10 remain in a static or dormant condition. Devices and methods for preventing unintended setting or activation of the tool 10 are disclosed in co-pending and commonly owned patent application Ser. No. 11/176,094, which is hereby incorporated by reference for all purposes.

Figure 3:
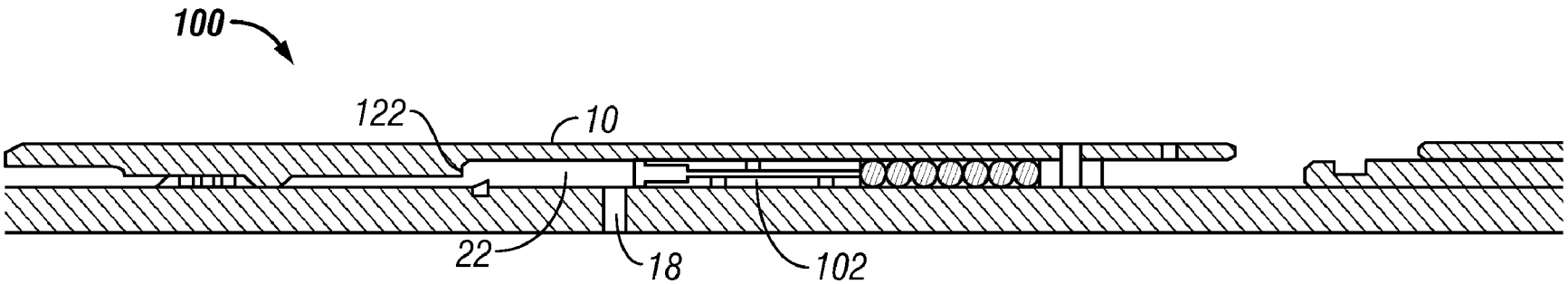
FIG. 3 illustrates a sectional view of embodiment of the isolation device during activation.

Referring now to FIG. 3, the tool 10 is shown in a condition where the pressure in the chamber 22 has reached a preset value and has caused the cylinder 14 to slide axially relative to the mandrel 16. This preset pressure value can be selected to fracture a device such as a shear screw 26 (FIG. 1) that initially fixes the cylinder 14 to the mandrel 16. In one embodiment, the preset pressure value or applied pressure in the chamber 22 is selected maintain the isolation device 100 in a pre-activated or dormant condition even after the shoulder 122 slides away from the sealing member 102. For example, the applied pressure can overcome the bias of the actuating member 110 (FIG. 1) and thereby urge the sealing device 102 in the direction 28 and can overcome the bias of the spring 120 (FIG. 2) and thereby hold the valve 114 in a closed position. Thus, the applied pressure in the chamber 22 effectively keeps the chamber 22 hydraulically sealed and in fluid communication with the bore 20.

Referring still to FIG. 3, once the cylinder 14 has completed its axial travel and the desired tool has be set or activated (e.g., slips), the pressure in the bore 20 and the chamber 22 is allowed to drop. As the pressure drops, the applied in the chamber 22 falls below the value needed to maintain the isolation device 100 in a pre-activated or dormant condition. Thus, once the applied pressure is unable to overcome the bias of the actuating member 110 (FIG. 1), the sealing device 102 moves in the direction 24 due to the actuating member 110 (FIG. 1). Also, the reduced applied pressure in unable to overcome the biasing element 120, which then pushes the valve 114 to an open position. Because the valve 114 is open, the chamber 22 is no longer hydraulically sealed; i.e., fluid can escape the chamber 22 via the conduit 116. Thus, advantageously, even after the sealing device 102 seals off the port 18, fluid can be bled from the chamber 22 via the conduit 116.

Figure 4:
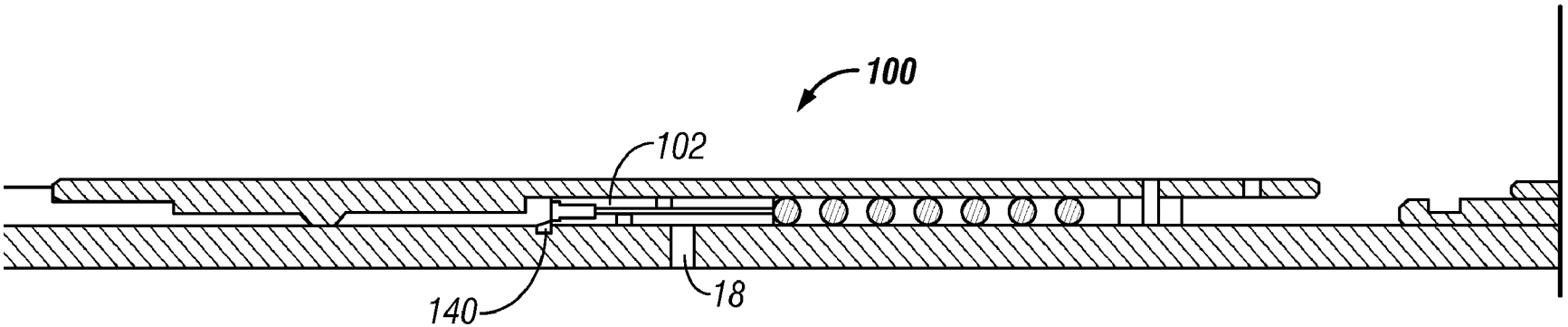
FIG. 4 illustrates a sectional view of embodiment of the isolation device after activation.

Referring to FIG. 4, the sealing device 102 is shown surrounding and Sealing off the port 18. In the embodiment shown, the body 106 and the seals 108*a,b* form a fluid barrier that prevents fluid communication between the bore 20 and the exterior portions of the tool 10. Thus, advantageously, the tool 10 is isolated from pressure variations, e.g., pressure increases, in the bore 20. It should be appreciated that such pressure isolation can simplify the design of the tool 10 and also increase the in-service reliability and robustness of the tool 10. For instance, the seals or packing 24 do not necessarily have to be configured to withstand pressures substantially beyond the pressure needed to operate the tool 10. Furthermore, the cylinder 14, which can have a relatively thin wall, also does not necessarily need specialized materials to withstand such pressures. In some arrangements, the isolation tool 100 can include a stop member 140 positioned on the mandrel 16 to axially position the sealing device 102 over the port 18. For example, the stop member 140 can be a snap ring or other protruding member located such that when the sealing device 102 abuts the stop member 140, the port 18 will be axially straddled by the seals 108*a,b*. Additionally, the stop member 140 can be configured to engage and close the valve 114 in much the same manner as the shoulder 122.

Figure 5:
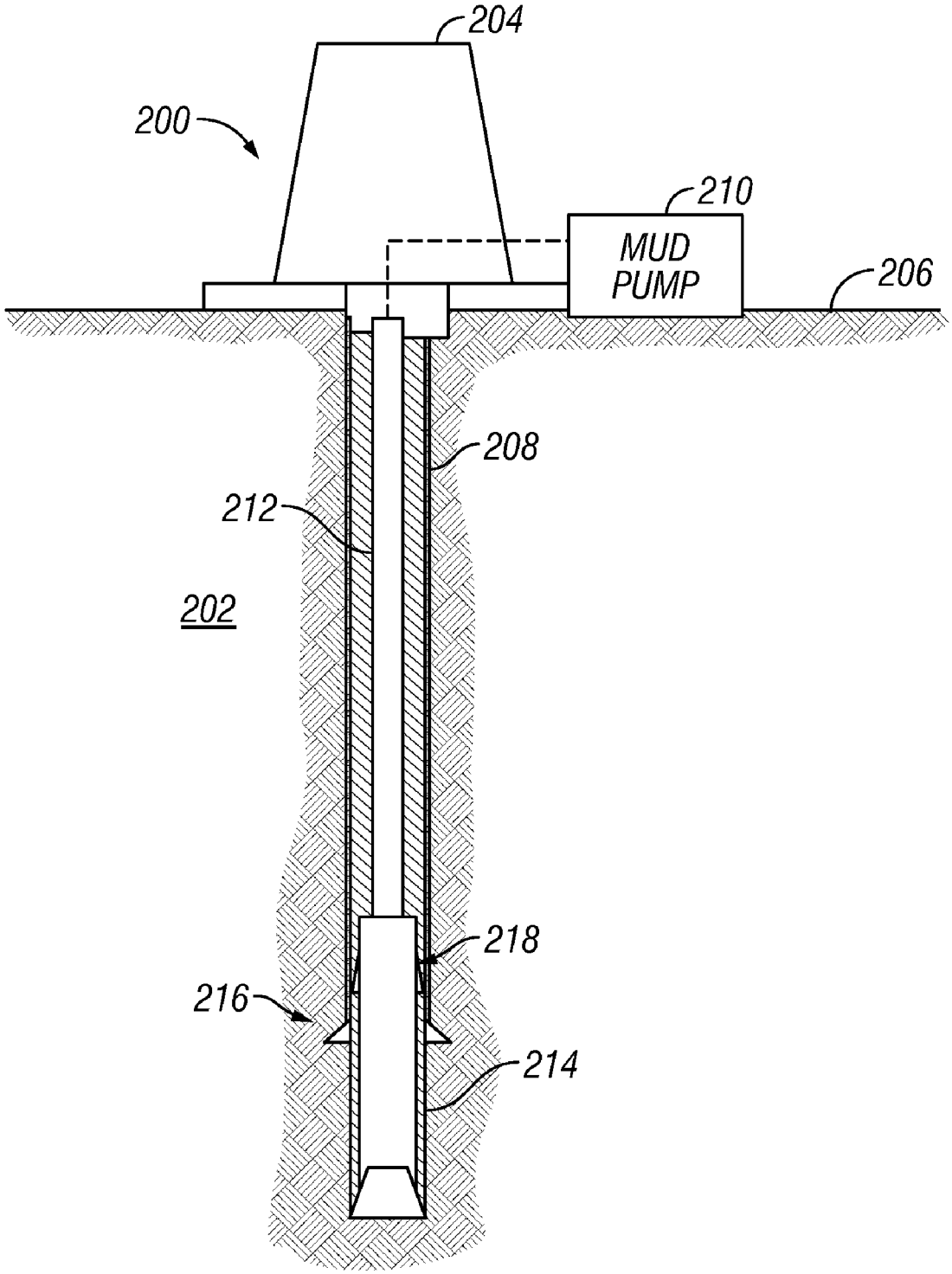
FIG. 5 schematically illustrates a sectional elevation view of a wellbore system utilizing an isolation device made in accordance with the present invention.

Referring now to FIG. 5, there is shown a well construction facility 200 positioned over subterranean formation 202. While the facility 200 is shown as land-based, it can also be located offshore. The facility 200 can include known equipment and structures such as a derrick 204 at the earth's surface 206, a casing 208, and mud pumps 210. A work string 212 suspended within a well bore 214 is used to convey tooling and equipment into the wellbore 214. The work string 242 can include jointed tubulars, drill pipe, coiled tubing, production tubing, liners, casing and can include telemetry lines or other signal/power transmission mediums that establish one-way or two-way data communication and power transfer from the surface to a tool connected to an end of the work string 212. A suitable telemetry system (not shown) can be known types as mud pulse, electrical signals, acoustic, or other suitable systems. The tooling and equipment conveyed into the wellbore can include, but are not limited to, fishing tools, expansion tools, bottomhole assemblies, tractors, thrusters, steering units, drilling motors, downhole pumps, completion equipment, perforating guns, tools for fracturing the formation, tools for washing the wellbore, screens and other production equipment.

For illustrative purposes, the work string 212 is shown as conveying a liner hanger assembly 216 into the wellbore 214. The liner hanger assembly 216 includes a liner hanger 218 and an isolation device 100. Once the liner hanger assembly 216 is positioned that a desired depth, the liner hanger 218 can be actuated in a convention manner. For example, a plug or ball can be "dropped" into a tubing bore to isolate fluid communication in the area of the desired depth. Thereafter, the mud pump 210 is operated to increase the applied pressure of the drilling fluid in the drill string 212. Referring now to FIGS. 1 and 5, once a sufficient pressure increase is created, the cylinder 14 slides longitudinally in a manner previously described to engage the slips or other tool. After the pump 210 is secured, the pressure in the work string 212 drops. Once this pressure drops below a preset pressure, the isolation device 100 is activated in a manner previously described and blocks off fluid communication between the interior and exterior of the work string 212. At this stage, the work string 212 can be pressured up to pressure test the liner hanger assembly 216. It should be appreciated that the integrity of the hanger assembly 216, e.g., hydraulic isolation, can be tested with without exposing the exterior elements of the liner hanger 218 to the elevated test pressures. In fact, advantageously, the positive closure of the port 18 by the isolation device 100 increases the overall reliability for the service life of the liner hanger 218.

It should further appreciated that the teachings of the present invention can be readily applied to numerous tools outside the liner drilling context. For example, in certain applications, fluids such as water, acids, fracturing fluids, may be circulated in the wellbore. Also, formation fluids such as oil and water can be utilized in some circumstances to energize the isolation device. Moreover, some embodiments of the present invention can be adapted for use in situations where fluid pressure is not used to energize a tool or device. For example, some tools may be actuated or energized by vibrations, mud pulse, motion of the tool, frequency, electronic signals, etc.

Additionally, it should be understood that the terms such as "first" and "second" and "uphole" and "downhole" do not signify any specific priority, importance, or orientation but are merely used in better describe the relative relationships between the items to which they are applied. Also, the term longitudinal generally refers to a direction along the long axis of a wellbore or tool, but as noted above, the isolation device is not limited to motion in any particular direction.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

The invention claimed is:

1. A method for actuating a pressure activated wellbore tool having a chamber and a port, comprising:

operatively connecting an isolation device to pressure activated wellbore tool, wherein the isolation device moves in response to a decrease in pressure;

conveying the pressure activated wellbore tool and the isolation device into a wellbore;

setting the pressure activated wellbore tool;

moving the isolation device by decreasing a pressure applied to the isolation device, to thereby substantially isolate at least a portion of the pressure activated wellbore tool from a wellbore pressure with the isolation device after setting the pressure activated wellbore tools;

flowing a fluid out of the chamber using a flow control device while moving the isolation device.

2. The method of claim 1 wherein the isolation device includes a sealing member, and further comprising sealing the port with the sealing member to substantially isolate the portion of the pressure activated well bore tool.

3. The method of claim 2 further comprising urging the sealing member into a sealing position with the port with an actuating member that applies a biasing force.

4. A method for actuating a pressure activated wellbore tool that has a pressure responsive chamber and a port, comprising:

operatively connecting an isolation device to the pressure activated wellbore tool, the isolating device having a sealing member;

conveying the pressure activated wellbore tool and the isolation device into a wellbore;

setting the pressure activated wellbore tool; and urging the sealing member into a sealing position with the port with an actuating member to substantially isolate at least a portion of the pressure activated wellbore tool from a wellbore pressure with an isolation device after setting the pressure activated wellbore tool, and flowing a fluid out of the chamber using a flow control device.

5. An apparatus for actuating a wellbore tool adapted for use in a wellbore, the wellbore tool having a port in communication with a fluid in a bore of the wellbore tool and a chamber in communication with the port, the wellbore tool having at least a portion exposed to a pressure associated with the fluid, the apparatus comprising:

a sealing member positioned proximate to the port, the sealing member movable to a sealing relationship with the port after the wellbore tool has been activated;

an actuating member configured to move the sealing member in response to a decrease in pressure; and a flow control element in the sealing member configured to flow the fluid out of the chamber.

6. The apparatus of claim 5 wherein the actuating member is configured to apply a biasing force to urge the sealing member into sealing engagement with the port.

7. The apparatus of claim 5 further comprising a retaining element retaining the actuating member in a pre-activated position.

8. The apparatus of claim 7 wherein the sealing member seals the chamber while the wellbore tool is being set.

9. The apparatus of claim 8 wherein a pressure in the pressure chamber retains the sealing member in a pre-activated position.

10. The apparatus of claim 5 wherein the wellbore tool includes a cylinder disposed around a mandrel, wherein the port is formed in the mandrel and wherein the sealing member is positioned between the cylinder and the mandrel.

11. The apparatus of claim 5 wherein the wellbore tool is a liner hanger.

12. An apparatus for actuating a wellbore tool adapted for use in a wellbore, the wellbore tool having a port in communication with a fluid in a bore of the wellbore tool and a pressure chamber that communicates with the wellbore tool bore via the port, the wellbore tool having at least a portion exposed to a pressure associated with the fluid, the apparatus comprising:

a sealing member positioned proximate to the port, the sealing member movable to a sealing relationship with the port to seal the pressure chamber after the wellbore tool has been activated, wherein the sealing member includes a flow element that selectively bleeds a fluid from the pressure chamber after the wellbore tool has been activated.

13. A system for performing one or more selected operations in a wellbore, comprising:

a rig at a surface location;

a work string disposed in the wellbore;

a wellbore tool coupled to the work string, the wellbore tool having a port in communication with a fluid in a bore of the wellbore tool and a chamber in communication with the port, the wellbore tool having at least a portion exposed to a pressure associated with the fluid;

a sealing member positioned in the wellbore tool and proximate to the port, the sealing member movable to a sealing relationship with the port after the wellbore tool has been activated; and an actuating member configured to move the sealing member in response to a decrease in pressure; and a flow control element in the sealing member configured to flow the fluid out of the chamber.

14. The system according to claim 13 further comprising a pump at the surface location adapted to selectively increase an applied pressure of the fluid in the work string to activate the wellbore tool.

15. The system according to claim 13 wherein the wellbore tool comprising a liner hanger assembly having a cylinder disposed around a mandrel in which the port is formed, the sealing member sealing the port after the cylinder has moved relative to the mandrel.

16. The system according to claim 15 wherein the isolation device isolates the pressure chamber.

17. The system according to claim 16 wherein the liner hanger includes slips adapted to extend radially upon a sliding motion of the cylinder.

18. The system according to claim 13 further comprising a pressure control device adapted to receive an occlusion member.

* * * * *